United States Patent [19]

Kawamoto

[11] Patent Number: 4,538,421

[45] Date of Patent: Sep. 3, 1985

[54] REFRIGERATING SYSTEM

[75] Inventor: Yasuo Kawamoto, Shimizu, Japan

[73] Assignee: Hitachi, Ltd., Tokyo, Japan

[21] Appl. No.: 600,907

[22] Filed: Apr. 16, 1984

[30] Foreign Application Priority Data

Apr. 15, 1983 [JP] Japan ..... 58-65354

[51] Int. Cl.[3] ..... F25B 13/00; F25D 17/02

[52] U.S. Cl. ..... 62/157; 62/160; 62/201; 62/228.5

[58] Field of Search ..... 62/228.5, 201, 160, 62/324.6, 324.1, 157, 231, 176.3, 229, 227, 226, 215, 228.1, 228.3; 236/1 EA, 46 F; 417/290, 310

[56] References Cited

U.S. PATENT DOCUMENTS

| | | | |
|---|---|---|---|
| 3,936,239 | 2/1976 | Shaw | 417/310 X |
| 4,076,461 | 2/1978 | Moody, Jr. et al. | 417/310 |
| 4,132,086 | 1/1979 | Kountz | 62/229 X |
| 4,249,866 | 2/1981 | Shaw et al. | 417/280 |

*Primary Examiner*—Harry Tanner

*Attorney, Agent, or Firm*—Antonelli, Terry & Wands

[57] ABSTRACT

A refrigerating system comprises screw compressor means which is adapted to control the capacity thereof by means of a slide valve provided in the compressor means and operatively associated with hydraulic actuator means. The hydraulic actuator means has hydraulic fluid supplying means and hydraulic fluid discharging means, both of which are connected thereto and provided with stop valve means, respectively, for controlling the supply and the discharge of a hydraulic fluid to and from the hydraulic actuator means to permit the latter to hydraulically actuate the slide valve. The refrigerating system further comprises means for selectively switching the operation mode of the system, means for detecting the outlet water temperature of an indoor heat exchanger of the system, and temperature control means for setting a water temperature for service. The temperature control means has a timer built therein and an arithmetic and logic circuit adapted to determine the operation period for the timer in proportion to the difference between the set water temperature and the outlet water temperature inputted from the detecting means. The slide valve is hydraulically actuated to effect the capacity control in proportion to the temperature difference under the control of control circuit means provided for interconnecting the timer with the stop valve means.

2 Claims, 4 Drawing Figures

REFRIGERATING SYSTEM

BACKGROUND OF THE INVENTION

The present invention relates to a refrigerating system employing a screw compressor and, more particularly, to a refrigerating system having a function of quickly controlling the capacity in response to a change in the refrigeration load. In general, the screw compressor for refrigerating purpose is equiped with a hydraulically operated slide valve. The capacity of the compressor can be controlled linearly and continuously by a suitable control of the slide valve.

Such a linear and continuous capacity control of the screw compressor by the slide valve is shown in, for example, Japanese Utility Model Publication No. 4564/1977. More specifically, this literature shows a screw compressor having a slide valve, which has additionally a suction block type capacity controller provided at the suction side thereof to widen a controllable range of the capacity of the compressor. In operation, when there is a drastic reduction in the load, the suction block type capacity controller having quick response characteristics responds first to the reduction and then the slide valve is operated, so that the capacity of the compressor can be varied over a wide range. In the refrigerators such as chilling units, however, there is a demand for compressors having a simpler capacity controller capable of quickly responding to a change in the load linearly and continuously.

Generally, the capacity control in refrigerators such as chilling units in response to the load demand is conducted in the following manner. Namely, the set temperature of a chilled water temperature controller or warmed water temperature controller is periodically compared with the outlet water temperature of an indoor heat exchanger, and when any difference between the set temperature and the outlet water temperature exists, the slide valve of the compressor is operated for a fixed predetermined time. Since the duration of operation of the slide valve is fixed regardless of the magnitude of temperature difference, it is often experienced that the capacity control fails in adequately responding to the load demand due to insufficiency of the control time, particularly when the difference between the set temperature and the water temperature is large.

SUMMARY OF THE INVENTION

It is an object of the invention to provide a refrigerating system incorporating a screw compressor having a capacity controller which can quickly and adequately accomodate the compressor to changes in the load while having a simple construction.

To this end, according to the invention, there is provided a refrigerating system comprising screw compressor means which is adapted to increase or decrease the flow rate of a refrigerant fluid flowing therethrough by means of a slide valve provided in the compressor means and operatively associated with hydraulic actuator means. The hydraulic actuator means has hydraulic fluid supplying means and hydraulic fluid discharging means which are connected thereto and provided with stop valve means, respectively, for controlling the supply and the discharge of a hydraulic fluid to and from the actuator means to permit the latter to hydraulically actuate the slide valve. The refrigerating system further comprises means for selectively switching the operation mode of the system, means for detecting the outlet water temperature of an indoor heat exchanger of the system, and temperature control means for setting a water temperature for service. The temperature control means has a timer built therein and an arithmetic and logic circuit adapted to determine the operation period for the timer in proportion to the difference between the set water temperature and the outlet water temperature inputted from the detecting means. Control circuit means is also provided for connecting the timer with the stop valve means to control the operation of the latter in proportion to the temperature difference.

Thus, according to the invention, the duration of operation of the slide valve, which inherently offers a linear capacity control of the screw compressor means, is changed in accordance with the difference between the outlet water temperature of the indoor heat exchanger and the set temperature of the chilled or warmed water temperature control means, such that the operation duration is increased as the temperature difference becomes greater and decreased as the temperature difference becomes smaller, thereby to attain a quick capacity control matching for the load of the refrigerating system.

According to the above-described arrangement, the time duration of opening or closing of the stop valve means disposed in the hydraulic fluid supplying and the hydraulic fluid discharging means is controlled in proportion to the temperature difference, so that the supply and discharge of the hydraulic fluid to and from the hydraulic actuator means for actuating the slide valve is quickly controlled within this time duration. Since the slide valve can open or close adequately, it is possible to effect the capacity control of the screw compressor means quickly in response to the change of the load.

BRIEF DESCRIPTION OF THE DRAWINGS

A preferred embodiment of the invention will be described in detail hereinunder with specific reference to the accompanying drawings, in which.

DESCRIPTION OF THE PREFERRED EMBODIMENTS

An embodiment of the invention will be described hereinunder with reference to the accompanying drawings.

Figure 1:
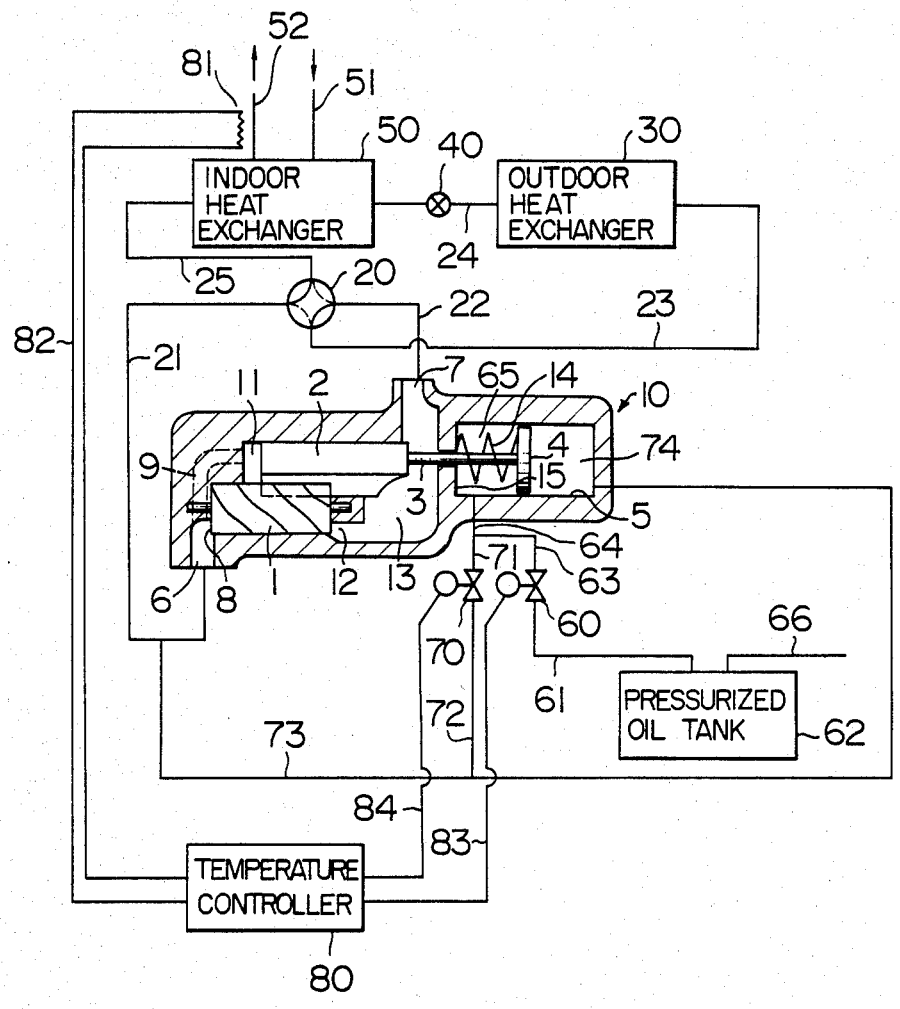
FIG. 1 is a system diagram of a refrigerating system incorporating a screw compressor, constructed in accordance with an embodiment of the invention.

Referring to FIG. 1 which is a system diagram of a refrigerator incorporating a screw compressor, the screw compressor is generally designated at a numeral 10. The compressor 10 has major parts such as a pair of screw rotors 1 one of which is directly connected to an electric motor (not shown), a slide valve 2 disposed on the pair of screw rotors 1, a hydraulic piston 4 connected to the slide valve 2 and slidably received by a hydraulic cylinder 5, a refrigerant gas suction port 6, and a refrigerant gas discharge port 7.

The screw rotors 1 are so formed and arranged in the conventional manner that they mesh with each other to successively define plural compression spaces as they rotate in opposite directions by means of the driving of the electric motor.

The refrigerant gas suction port 6 communicates with an inlet 8 of each compression space formed around the meshing point of the pair of screw rotors 1 and also with a space 11 which is formed above the screw rotors 1 and on one end side of the slive valve 2 when the latter moves to the right as viewed in FIG. 1, through a passage 9.

The refrigerant gas discharge port 7 communicates through a passage 13 with an outlet 12 of each compression space formed in the area around the separating point of the pair of screw rotors 1. A reference numeral 14 designates a spring mounted between the side wall 15 of the hydraulic cylinder 5 and one end surface of the hydraulic piston 4 to normally urge the slide valve 2 in the opening direction. However, the biasing force of the spring 14 is set to be weaker than that applied to the other end of the slide valve by the pressure of a compressed refrigerant gas so as to force the slide valve under the predetermined conditions as will be described hereinafter. A reference numeral 20 denotes a four-way valve connected through a suction pipe 21 to the refrigeration gas suction port 6 of the screw compressor 10 and also to the refrigerant discharge port 7 through a discharge pipe 22. A heat exchanger 30 on the outdoor side of the system is connected at its one end to the four-way valve 20 through a pipe 23 and at its other end to another heat exchanger 50 on the indoor side through a pipe 24 having an expansion valve 40. The heat exchanger 50 is connected at its other end to the four-way valve 20 through a pipe 25. Water is introduced through a water inlet pipe 51 into the heat exchanging region of the heat exchanger 50 for exchanging heat with the refrigerant gas which is also introduced into this heat exchanger 50, and is discharged from the heat exchanging region through a water outlet pipe 52.

A solenoid valve 60 is connected at its inlet side to a pressurized oil tank 62 through an oil pipe 61 and at its outlet side to a space 65 formed in the hydraulic cylinder 5 through oil pipes 63 and 64 for supplying oil in the space 65. A reference numeral 66 designates an oil supplying pipe for supplying the oil under high pressure to the tank 62. Another solenoid valve 70 is connected at its inlet side to the oil pipe 64 through an oil pipe 71 and at its outlet side to the suction pipe 21 through an oil pipe 72 and a low-pressure pipe 73 for discharging the oil from the space 65. The other end of the low-pressure pipe 73 is connected to a space 74 in the hydraulic cylinder 5 to maintain the pressure in the space 74 at a low level.

A temperature controller 80 with a built-in timer, adapted for free adjustment of set temperature, is electrically connected through a signal line 82 to a temperature sensor 81 serving as temperature detecting means, which is provided in contact with the water outlet pipe 52 of the heat exchanger 50. The temperature controller 80 is connected at its output side to the solenoid valve 60 and the solenoid valve 70 through signal lines 83 and 84, respectively.

Figure 2:
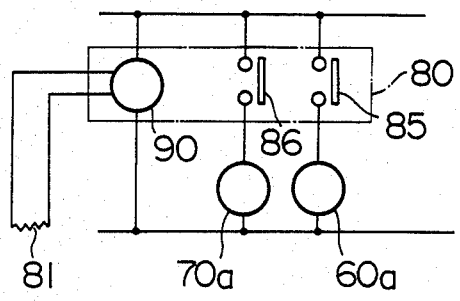
FIG. 2 is a schematic diagram showing a major part of the control circuit of the embodiment.

Referring now to FIG. 2 schematically showing the temperature controller 80, the coils 60*a* and 70*a* of both solenoid valves 60 and 70 are connected, respectively, in series to an oil supplying timer contact 85 and an oil discharging timer contact 86.

A reference numeral 90 denotes a computing circuit. The computing circuit is adapted to compare the water temperature sensed by the water temperature sensor 81 with the set temperature which is beforehand set in the temperature controller 80. On the basis of the result of the comparison, the computing circuit computes opening durations for the contacts 85 and 86 and delivers signals for representing adequate opening and closing durations to the solenoid valves.

The operation of the embodiment will be described hereinunder.

First, the operation for producing chilled water will be described. The refrigerant gas compressed to a high pressure and temperature by the screw compressor 10 is discharged from the discharge port 7. The refrigerant gas flows into the heat exchanger 30 serving as a condenser, through the discharge pipe 22, a passage formed in the four-way valve 20 as indicated by a full line in FIG. 1 and the pipe 23. The gas is then condensed and liquefied as a result of the heat exchange with air or water in the heat exchanger 30. The condensate is then introduced through the pipe 24 into the expansion valve 40 in which the refrigerant is expanded to be a low pressure, and is introduced into the heat exchanger 50 serving as an evaporator. The refrigerant under low pressure makes a heat exchange with water which is introduced into the heat exchanger 50 through the inlet pipe 51, so that the water is chilled to a low temperature while the refrigerant is evaporated into gaseous phase. The thus chilled water is led to the outside of the heat exchanger 50 through the outlet pipe 52 to serve as, for example, the heat source for air conditioning. On the other hand, the refrigerant gas after cooling the water is delivered through the pipe 25, a passage of the four-way valve 20 as illustrated by a full line and then through the suction pipe 21 into the suction port 6 of the screw compressor 10. The refrigerant gas is again compressed by the screw compressor 10 and is circulated through the refrigerating system described hereinbefore.

For producing warm water, the four-way valve 20 is switched to open passages as indicated by broken lines in FIG. 1 so that the heat exchanger 30 and the heat exchanger 50 perform their heat exchange in a manner reverse to that described hereinbefore on the operation for producing chilled water, thereby to permit the refrigerator to produce warm water.

The capacity of the screw compressor is minimized to about 25 to 35% of the full capacity thereof, when the slide valve 2 is fully moved to the right as viewed in FIG. 1 to release the refrigerant through the passage 9. For conducting a continuous control of the capacity, therefore the slide valve 2 is progressively moved to the right as viewed in FIG. 1, by supplying the pressurized oil to the space 65 in the hydraulic cylinder 5. To the contrary, for continuously increasing the capacity of the compressor, the oil is discharged from the space 65 to permit the slide valve 2 to progressively move towards the starting position. The pressure in the space 74 of the hydraulic cylinder 5 is maintained at a sufficiently low level. The pressurized oil is supplied from the pressurized oil tank 62 through the solenoid valve 60, while the discharge of the oil is made through the solenoid valve 70 to the low-pressure side of the refrigeration system. FIG. 1 shows the compressor in a state in which the spring 14 is not fully compressed, i.e. in the state of partly unloading the compression operation to permit a part of the compressed gas to be relieved to the suction side of the compressor. After the compressor has been fully stopped, the solenoid valve 60 is opened to permit the supply of the oil to the space 65 and, at the sametime, the hydraulic piston 4 is fully moved to the right by the force of the spring 14, so as to set the slide valve 2 at the maximum open position, thereby to allow the compressor to operate with the minimum load when the same is started again.

Figure 4:
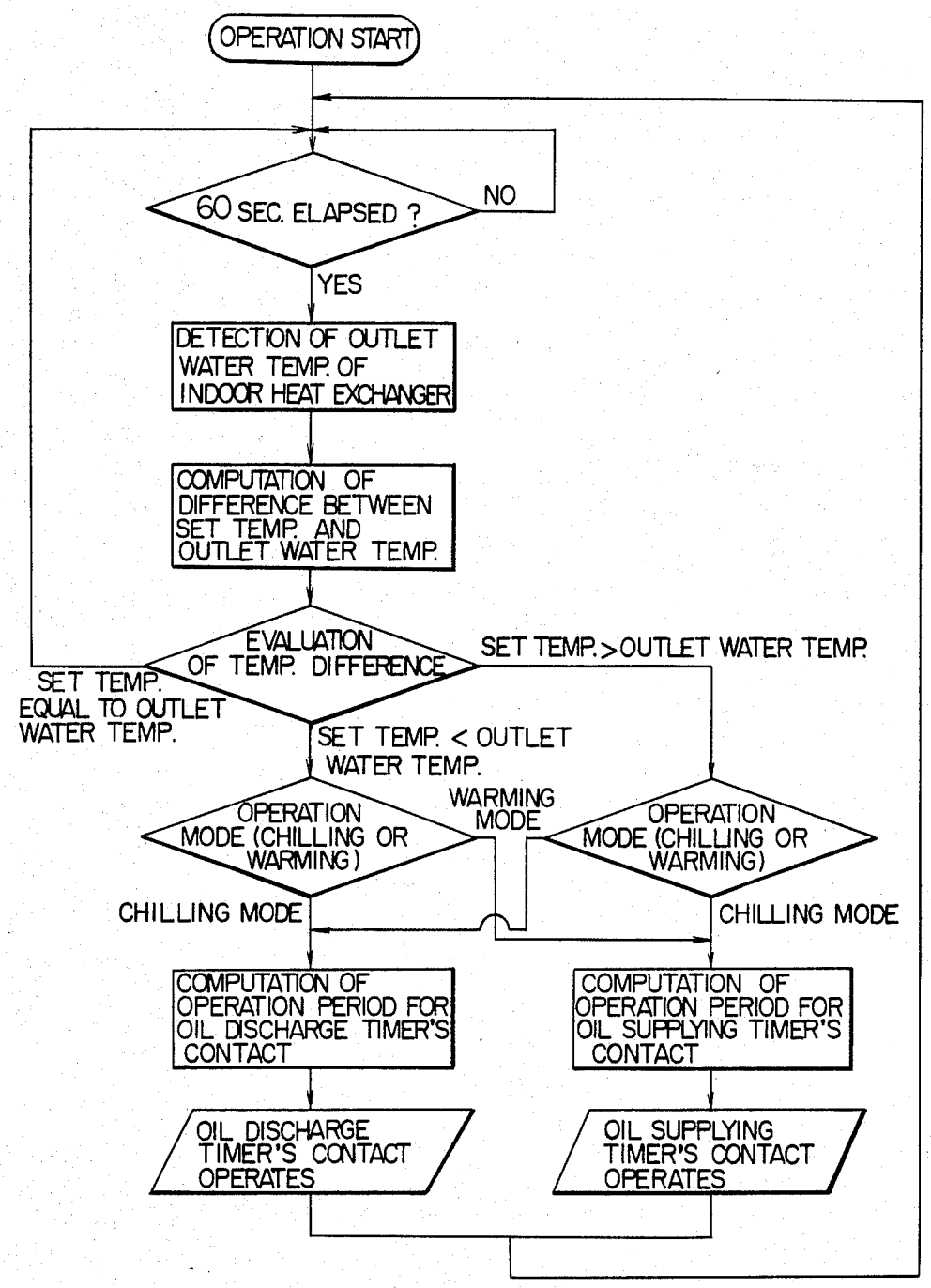
FIG. 4 is a flow chart of a program of the capacity control of the refrigerating system.

The normal operation of the compressor after the start up is controlled in accordance with the program flow chart shown in FIG. 4.

The temperature of the water flowing through the water outlet pipe 52 from the heat exchanger 50 is sensed by the temperature sensor 81 at a suitable period of, for example, 60 seconds. The temperature signal is inputted to the computing circuit 90 of the temperature controller 80, and is compared with that of the set temperature in the temperature controller 80. If the set temperature and the outlet water temperature are equal, the computing circuit 90 does not make any further computation to stand by for the following 60 seconds. However, when the outlet water temperature is higher or lower than the set temperature, the computing circuit 90 commences computing a duration for operating the timer contacts.

For instance, in the operation for producing chilled water, assuming that the set temperature in the temperature controller 80 is 7° C. while the outlet water temperature takes a level above the set temperature due to an increment of load, e.g. 11° C., so that there is a demand for a further chilling of water. In such case, the computing circuit computes the operation duration of the slide valve 2 corresponding to the temperature difference which is in this case 4 degrees. More specifically, the computing circuit determines the operation duration of the discharge timer contact 86 of this case to be 10 seconds on the basis of the operation characteristics shown in the diagram of FIG. 3.

In the conventional capacity controller, this operation duration is fixed to be about 5 seconds. According to the invention, however, the time duration of operation of the slide valve is increased or decreased in proportion to the magnitude of the difference between the set temperature and the outlet water temperature, thereby to permit a continuous linear capacity control of the compressor. Consequently, the compressor can be quickly accomodated with changes in the load and can be operated under an adequate capacity control.

Figure 3:
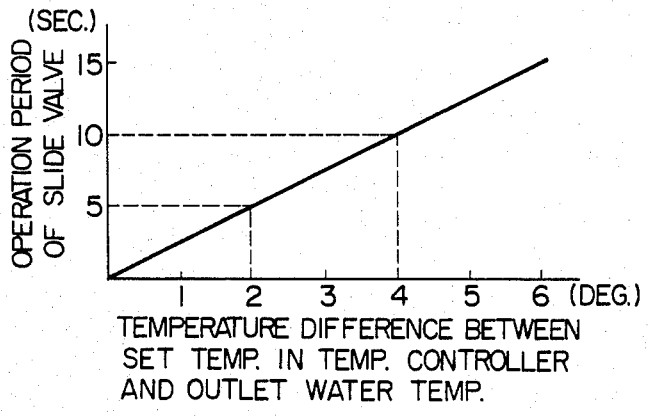
FIG. 3 is a diagram showing the operation characteristics of a slide valve.

After 10 seconds has elapsed, the solenoid valve 70 is closed and stands by for a next signal. The operation characteristics shown in the diagram of FIG. 3 is not fixed but may be varied depending on various factors such as the capacity of a screw compressor and the capacity of a service heat exchanger.

To the contrary, when the outlet water temperature has come down below 5° C., i.e. when the outlet water temperature is below the set temperature, the capacity control of the compressor is conducted in accordance with the operation mode which is shown into the right part of the flow chart of FIG. 4. Namely, in this case, the computing circuit computes the duration of operation of the slide valve 2, i.e. the operating duration of the oil supplying solenoid valve 85 corresponding to the temperature difference of 2 degrees, to be 5 seconds as will be seen from the diagram of FIG. 3. Thus, the solenoid valve 60 is kept opened for 5 seconds to permit the supply of the pressurized oil to the space 65 to increase the unloaded amount of the refrigerant.

Although the above description has been made with specific reference to the chilling operation, the invention can be applied also to the case of a warming operation for producing warm water. Namely, the computation of operation durations for the oil discharging timer contact 86 and the oil supplying timer contact 85 is conducted in accordance with the result of comparison between the set temperature and the outlet water temperature, after switching the operation mode of the system.

What is claimed is:

1. A refrigerating system comprising screw compressor means which is adapted to control the flow rate of a refrigerator fluid flowing therethrough by means of a slide valve provided in said compressor means and operatively associated with hydraulic actuator means, said hydraulic actuator means having hydraulic fluid supplying means and hydraulic fluid discharging means which are connected thereto and provided with stop valve means, respectively, for controlling the supply and the discharge of a hydraulic fluid to and from said hydraulic actuator means to permit said hydraulic actuator means to hydraulically actuate said slide valve thereby to increase or decrease the flow rate of the refrigerant fluid in said compressor means, wherein the improvement comprising:

means for selectively switching the operation of said system from either one of a mode for producing warmed water and a mode for producing chilled water to the other mode;

detecting means for detecting the outlet water temperature of an indoor heat exchanger of said system;

temperature control means for setting a water temperature for service, said temperature control means having a timer built therein and an arithmetic and logic circuit adapted to evaluate the difference between the set water temperature and the outlet water temperature inputted from said detecting means and compute the operation period of said timer in proportion to the evaluated temperature difference;

control circuit means for connecting said timer with said stop valve means to control the operation of said stop valve means in proportion to the temperature;

wherein said slide valve is adapted to be subjected at one end thereof to the pressure of the compressed refrigerant fluid, said hydraulic actuator means comprises a piston connected to said slide valve, a cylinder slidably receiving said piston and a spring mounted between said piston and said cylinder to urge said slide valve through said piston in a direction for decreasing the flow rate of the refrigerant fluid when the pressure of the compressed refrigerant fluid acting on said slide valve is below a predetermined value, said hydraulic fluid supplying means comprises a hydraulic fluid supplying passage and a pressurized hydraulic fluid tank, and said hydraulic fluid supplying passage interconnects said pressurized hydraulic fluid tank in fluid communication with said cylinder through said stop valve means and opens into a space defined in said cylinder on the urged side of said piston.

2. A refrigerating system as claimed in claim 1, wherein said hydraulic fluid discharging means comprises a hydraulic fluid discharging passage which connects said space of the cylinder in fluid communication with a low pressure side of said system through said stop valve means.

* * * * *